United States Patent [19]

Smith

[11] 4,328,733

[45] May 11, 1982

[54] SLIDE BAR HOLDER DEVICE FOR HAWAIIAN GUITAR

[76] Inventor: Walter E. Smith, P.O. Box 707, Weiser, Id. 83672

[21] Appl. No.: 243,995

[22] Filed: Mar. 16, 1981

[51] Int. Cl.[3] ..... G10D 3/16

[52] U.S. Cl. ..... 84/319

[58] Field of Search ..... 84/319

[56] References Cited

U.S. PATENT DOCUMENTS 1,618,884 2/1927 Meyer ..... 84/319

2,647,429 8/1953 Smith ..... 84/319

*Primary Examiner*—Lawrence R. Franklin

*Attorney, Agent, or Firm*—Lyon & Lyon

[57] ABSTRACT

A slide bar for the strings of a guitar is provided with a holder device attached thereto and having at least one wing member shaped for contact with the thumb of the user. An element which may constitute a second wing member defines with the bar and first wing member a recess for the index finger of the user. One or both wing members are sufficiently flexible to enable the user to grip the index finger between the first said wing member and said element by applying lateral pressure between the thumb and the middle finger.

6 Claims, 8 Drawing Figures

SLIDE BAR HOLDER DEVICE FOR HAWAIIAN GUITAR

This invention relates to a slide bar holder device for a Hawaiian guitar, and this invention relates to improvements over slide bar devices shown in my prior U.S. Pat. Nos. 3,386,325, 3,398,622, and 3,822,629.

It is known that it takes considerable skill and practice properly to hold and manipulate a cylindrical or tapered slide bar for proper action on the strings of a guitar. Children, or beginners, or physically handicapped persons, often have great difficulty in gripping and moving the slide bar as well as using the fingers of the gripping hand to contact the strings to prevent unwanted "buzzing" sounds. Accordingly, it is an important object of the present invention to provide a slide bar and holder which enhances the grip of the user so that the device is much easier to hold and to manipulate.

This general object is achieved by providing one or more wing members attached to the slide bar and being flexible enough to enhance the gripping action on the index finger when lateral pressure is exerted between the thumb and the middle finger. Also, the thumb contacts one of the wind members at a location above the centerline of the slide bar for better grip action. Other and more detailed objects and advantages will appear hereinafter.

Figure 1:
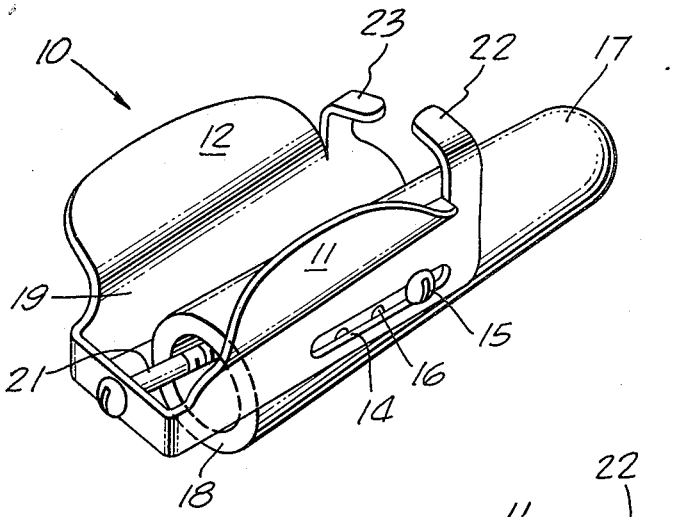
FIG. 1 is a perspective view showing a preferred embodiment of this invention.
Figure 2:
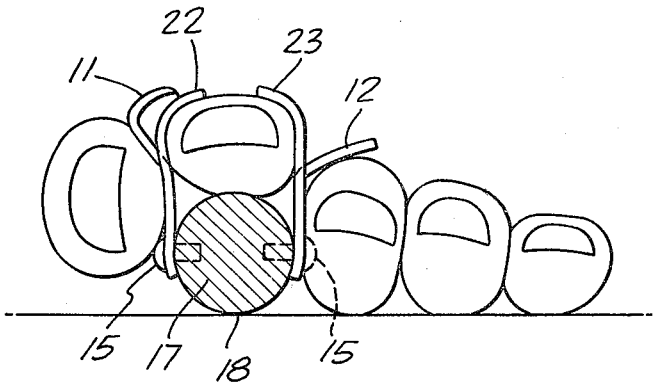
FIG. 2 is an end view showing the same device in position between the thumb and fingers of the user.

Referring to the drawings, and particularly to FIGS. 1 and 2 thereof, the holder device generally designated 10 includes a pair of laterally spaced contoured wing members 11 and 12 and joined by an integral rear tab 13. The wing members 11 and 12 are provided with axial slots 14 through which threaded elements 15 pass and which are recieved in any one of a series of threaded sockets 16 provided in the slide bar 17. The slide bar 17 has an outer surface 18, the lower portion of which is adapted for sliding contact with the strings of a guitar.

The wing members 11 and 12 and the outer surface 18 of the slide bar 17 cooperate to define a recess 19 for the index fingers of the user. The slide bar 17 is hollow and may be closed at its forward end. Its rearward end lies adjacent the rear tab 13 joining the wing members 11 and 12. An element 21 is mounted on the rear tab 13 and projects into the hollow interior of the slide bar 17 in order to limit the extent of pivotal movement of the holder 10 with respect to the slide bar 17, and around the pivotal axis formed by the threaded elements 15. This limiter element 21 may conveniently take the form of a screw threaded through the rear tab 13 and may be provided with a convenient exposed head portion.

The threaded elements 15 and slots 14 permit relative longitudinal movement as well as pivotal movement between the holder 10 and the slide bar 17. The limiter element 21 limits the relative pivotal movement for any longitudinal position between the holder device 10 and the slide bar 17.

A curved tab 22 is provided at the forward end of the wing member 11, and similarly a curved tab 23 is provided at the forward end of the wing member 12. These curved tabs cooperate to embrace the index finger when positioned in the recess 19 between the wing members 11 and 12.

As best shown in FIG. 2 of the drawings, the thumb of the user contacts the outer surface of the wing member 11, and the middle finger of the user contacts the outer surface of the wing member 12. One or both of the wing members are sufficiently flexible to grip the index finger between the wing members when lateral pressure is applied by the user between the thumb and the middle finger. This lateral pressure also serves to enhance the gripping of the index finger by means of the curved tabs 22 and 23. The thumb has liberal clearance above the strings.

Figure 3:
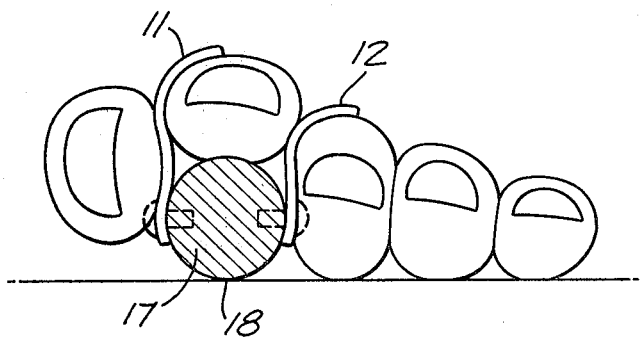
FIG. 3 is a view similar to FIG. 2 showing a modified form of the device.

The device shown in FIG. 3 is similar to that shown in FIGS. 1 and 2 except that the curved tabs 22 and 23 are omitted. In either of the devices of FIGS. 2 and 3, a beginner can apply adequate pressure on the third, fourth and fifth fingers behind the bar 17 to muffle any buzzing sound caused by the bar when it is raised or lowered with respect to the strings. In general, the lower the top of the bar, the easier it is to apply the pressure with the bar in level position across the strings. This is especially true if the user has small hands.

Figure 4:
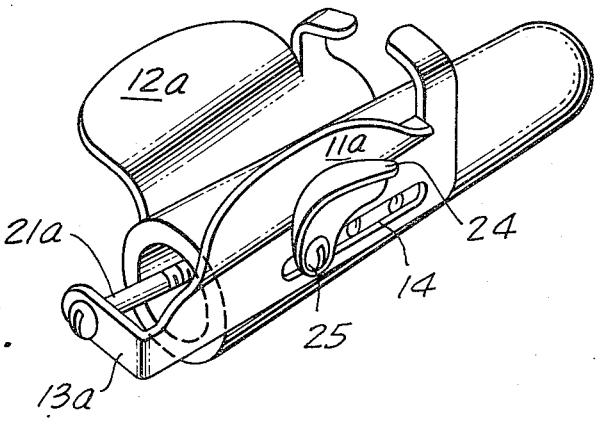
FIG. 4 is a perspective view showing another modification.
Figure 5:
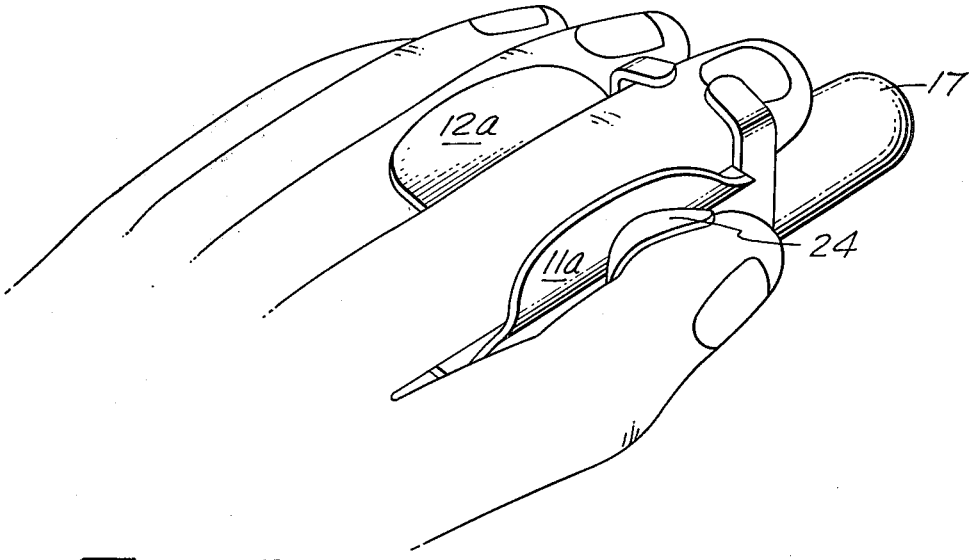
FIG. 5 is a perspective view showing the device of FIG. 4 in position between the thumb and fingers.

In the modified form of the invention shown in FIGS. 4 and 5, the construction is similar to that shown in FIGS. 1 and 2, and in addition there is a thumb contact piece 24. This piece 24 is secured to the wing member 11*a* by means of threaded fastening 25 passing through the slot 14 and into a threaded receptacle in the slide bar 17. The upper surface of the thumb engages the underside of the lip on the thumb contact piece 24 to improve the gripping action of the thumb.

In this form of this invention, the rear tab 13*a* is formed as an integral part of the wing member 11*a* rather than being attached to the wing member 12*a*. The limiter element 21*a* is similar to that previously described, and a portion extends into the hollow interior of the slide bar 17. This serves to limit the pivotal action of the wing member 11*a* about the threaded fastening 25. The thumb contact piece 24 has surface contact with the wing member 11*a* so that lateral squeezing movement between the thumb and the middle finger serves to enhance the grip on the index finger positioned between the wing members 11*a* and 12*a*.

Figure 6:
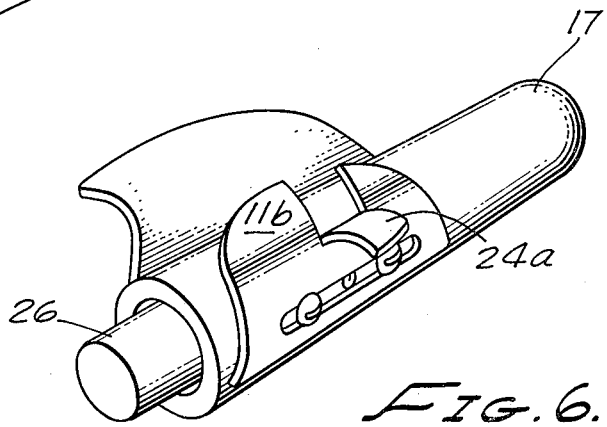
FIG. 6 is a perspective view showing another modification.

In the modified form of the invention shown in FIG. 6, the thumb contact piece 24*a* is formed as an integral part of the wing member 11*b* instead of being formed as a separate piece. Also in the device of FIG. 6, the rear tab 13 is eliminated, and instead a core element 26 is adjustably mounted within the hollow slide bar 17 and projects axially from the open end thereof. The projecting length of the core element 26 is selected so that it engages the fleshy portion of the palm of the hand adjacent the index finger, and thereby improves the grip on the holder and slide bar 17.

Figure 7:
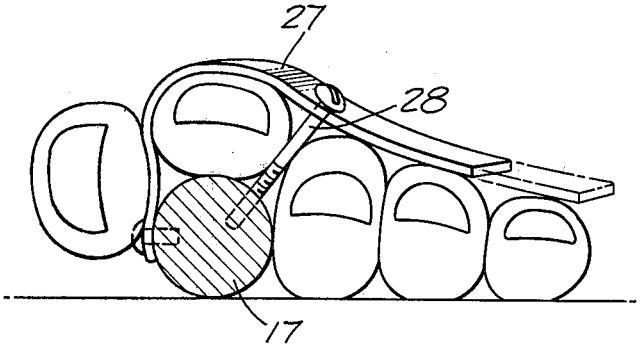
FIG. 7 is and end view showing another modification.

In the modified form of the invention shown in FIG. 7, only one wing member 27 is secured to the slide bar 17. This wing member 27 has an outer surface which is engaged by the thumb and has an inner surface which is contacted by the index finger, the middle finger, and possibly the fourth finger. A distinguishing feature of this form of the invention is the use of the threaded element 28 which extends through the wing member 27 and engages a threaded socket provided in the slide bar 17. The index finger and the middle finger both contact this threaded element 28. Lateral squeezing movement between the thumb and the middle finger serves to enhance the grip between the index finger and the slide bar 17.

Figure 8:
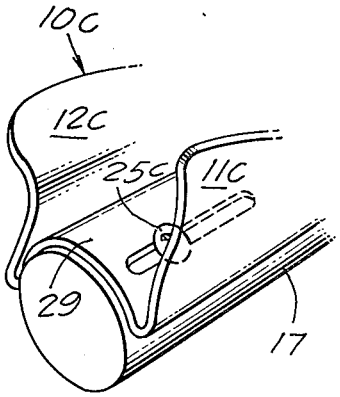
FIG. 8 is a perspective view showing a further modification.

In the form of the invention shown in FIG. 8, the holder 10*c* is formed of one piece which includes the wing members 11*c* and 12*c* both formed integrally with the curved base 29 which has surface contact with the slide bar 17. The base 29 may be provided with an axial slot for reception of the threaded fastening 25*c*, to permit axial adjustment between the holder 10*c* and the slide bar 17. When the index finger is positioned on the curved base 29, and between the wing members 11*c* and 12*c*, lateral pressure between the thumb and the middle finger serves to enhance the grip of the wing members 11*c* and 12*c* on the index finger.

Having fully described my invention, it is to be understood that I am not to be limited to the details herein set forth but that my invention is of the full scope of the appended claims.

I claim:

1. A slide bar device for use on the strings of a guitar, or the like, comprising: a hollow bar having an outer surface for contact with the strings, a core adjustably mounted to move axially within said hollow bar, and having a portion projecting from the rearward end of said bar, a pair of spaced wing members adjustably secured to said bar, said wing members defining a recess for the index finger of the user, one of said wing members being adapted for contact with the thumb of the user and the other of said wing members being adapted for contact with the middle finger of the user, at least one of said wing members being sufficiently flexible to enable the user to grip the index finger between said wing members by applying lateral pressure between the thumb and the middle finger.

2. A slide bar device for use on the strings of a guitar, or the like, comprising: a bar having an outer surface for contact with the strings, a pair of spaced wing members pivoted to said bar and defining with the bar a recess for the index finger of the user, one of said wing members being shaped for contact with the thumb of the user and the other of said wing members being shaped for contact with the middle finger of the user, a curved tab on the forward end of each wing member, a bridge piece joining the rearward ends of said wing members and confronting the rear end of said bar, and cooperating means on said bridge piece and said bar for limiting the extent of pivotal movement between them, said wing members being sufficiently flexible to enable the user to grip the index finger between said wing members by applying lateral pressure between the thumb and the middle finger, said lateral pressure causing said curved tabs to encircle the index finger.

3. A slide bar device for use on the strings of a guitar, or the like, comprising: a bar having an outer surface for contact with the strings, an integral pair of spaced wing members secured to said bar and defining with the bar a recess for the index finger of the user, one of said wing members being adapted for contact with the thumb of the user and the other of said wing members being adapted for contact with the middle finger of the user, said wing members being sufficiently flexible to enable the user to grip the index finger between said wing members by applying lateral pressure between the thumb and the middle finger.

4. A slide bar device for use on the strings of a guitar, or the like, comprising: a bar having an outer surface for contact with the strings, a pair of spaced wing members attached to said bar and defining with the bar a recess for the index finger of the user, one of said wing members being adapted for contact with the thumb of the user and the other of said wing members being adapted for contact with the middle finger of the user, at least one of said wing members being sufficiently flexible to enable the user to grip the index finger between said wing members by applying lateral pressure between the thumb and the middle finger.

5. A slide bar device for use on the strings of a guitar, or the like, comprising: a bar having an outer surface for contact with the strings, a pair of spaced wing members mounted to slide axially on said bar and defining with the bar a recess for the index finger of the user, one of said wing members being shaped for contact with the thumb of the user and the other of said wing members being shaped for contact with the middle finger of the user, a curved tab on the forward end of each wing member, at least one of said wing members being sufficiently flexible to enable the user to grip the index finger between said wing members by applying lateral pressure between the thumb and the middle finger, said lateral pressure causing said curved tabs to encircle the index finger.

6. A slide bar device for use on the strings of a guitar, or the like, comprising: a bar having an outer surface for contact with the strings, a pair of spaced wing members pivoted to said bar and defining with the bar a recess for the index finger of the user, one of said wing members being shaped for contact with the thumb of the user and the other of said wing members being shaped for contact with the middle finger of the user, a rear tab fixed to at least one of the rearward ends of said wing members and confronting the rear end of said bar, cooperating means on said rear tab and said bar for limiting the extent of pivotal movement between them, said wing member being sufficiently flexible to enable the user to grip the index finger between said wing members by applying lateral pressure between the thumb and the middle finger.

* * * * *